US005383401A

United States Patent [19]

Brotzman

[11] Patent Number: 5,383,401

[45] Date of Patent: Jan. 24, 1995

[54] ACTUATING DEVICE FOR CLAMPING ARRANGEMENT FOR PRINTING PLATES IN ROTARY PRINTING PRESSES

[75] Inventor: John M. Brotzman, Freeport, Me.

[73] Assignee: Heidelberg Druckmaschinen AG, Heidelberg, Germany

[21] Appl. No.: 200,164

[22] Filed: Feb. 22, 1994

[51] Int. Cl.[6] ..... B41F 21/00

[52] U.S. Cl. ..... 101/415.1; 101/378

[58] Field of Search ..... 101/415.1, 409, 410, 101/378, 382, 383

[56] References Cited

U.S. PATENT DOCUMENTS

| | | | |
|---|---|---|---|
| 3,016,010 | 1/1962 | Luehrs . | |
| 3,217,644 | 11/1965 | Schmidt . | |
| 3,276,365 | 10/1966 | Langer . | |
| 3,359,899 | 12/1967 | Luehrs . | |
| 3,534,694 | 10/1970 | Tafel et al. | 101/378 |
| 3,552,314 | 1/1971 | Skinner et al. | 101/378 |
| 3,563,176 | 2/1971 | Ferguson | 101/378 |
| 3,625,150 | 12/1971 | Wurzburg | 101/378 |
| 3,903,795 | 9/1975 | Suzuki | 101/409 |
| 4,207,815 | 6/1980 | Watanabe | 101/248 |
| 4,259,695 | 3/1981 | Nakano | 101/415.1 |
| 4,277,164 | 7/1981 | Fortmann | 101/415.1 |
| 4,495,865 | 1/1985 | Kamoda . | |
| 5,168,810 | 12/1992 | Kojima | 101/415.1 |
| 5,317,968 | 6/1994 | Saitou et al. | 101/415.1 |
| 5,322,014 | 6/1994 | Keller | 101/415.1 |

*Primary Examiner*—Eugene H. Eickholt
*Attorney, Agent, or Firm*—Tarolli, Sundheim & Covell

[57] ABSTRACT

The invention relates to an actuating device for clamping arrangements for printing plates in rotary printing presses. The printing unit cylinders receiving the printing plates are provided with at least one opening extending in the axial direction. Through actuating means fastened to the ends of the printing unit cylinder the printing plates can be tightened on the surface of the printing unit cylinder. The actuating means are operable by an actuating unit provided at one end of the printing unit cylinder. The invention is characterized in that the actuating unit (32) includes an overrunning clutch (30) which determines the rotational position of an actuating shaft (9), the actuating unit being spring-biased and comprising an axially movable component (27).

14 Claims, 3 Drawing Sheets

9
11
10
29
27
26
24
19

9
22
23
10
11
29
27
30
28
31
26
25
24
22
19
20
21

ACTUATING DEVICE FOR CLAMPING ARRANGEMENT FOR PRINTING PLATES IN ROTARY PRINTING PRESSES

FIELD OF THE INVENTION

The invention relates to an actuating device for clamping arrangements for printing plates in rotary printing presses.

BACKGROUND OF THE INVENTION

Devices which clamp printing plates on printing unit cylinders are known in the art. The printing unit cylinders are provided with at least one opening extending across the width of the respective cylinder. Actuating means fastened to the ends of the printing unit cylinder allow for tightening the printing plates on the outer cylindrical surface of the printing unit cylinder. The actuating means of printing unit cylinders are operable by means of an actuating unit mounted on one or both ends of the printing unit cylinder.

The state of the art, namely U.S. Pat. No. 3,016,010, discloses a tightening device for flexible printing plates. Both ends of a printing plate are clamped in a longitudinal slot of a cylinder having an actuating shaft with spring-loaded tightening elements. Both ends of the printing plate overlap each other while spring-biased collars and spring-biased engaging means are in operative engagement with the plate ends. The actuation of the shaft is achieved by means of a worm gear which is self-locking. The worm gear is provided with a tool-receiving arrangement which allows the worm gear to revolve, thereby rotating the actuating shaft. However, a tool is required for actuating the worm gear and the tightening process with the actuating shaft is rather time-consuming, since due to the reduction gear ratio, a revolution of the worm gear only results in a minimum movement of the actuating shaft.

U.S. Pat. No. 3,276,365 discloses a printing plate clamping device for a printing press. A self-arresting worm gear effects the rotation of a shaft. This shaft is formed with longitudinally extending teeth meshing with teeth formed on one side of a bar. The disadvantages of a worm gear have been outlined above.

U.S. Pat. No. 3,217,644 discloses a clamping means for mounting carrier sheets on flat or round surfaces. A cam provided with a flat is turnable by means of a manually actuatable member of a journal block. The actuatable members or arms project from their respective slots beyond the journal block, thus forming a source of danger during rotation of the cylinder. The lever mechanism only allows a turning of the cam within a narrow limited area, thus, restricting the tensioning force exerted upon the printing plate.

U.S. Pat. No. 3,359,899 shows a spring-tensioned wrap-around plate cylinder clamping arrangement. The jaws clamping the plates on the outer cylindrical surface of a cylinder are actuated by means of a tubular shaft. The rotational movement of the tubular shaft causes a translatory movement of pins engaging a jaw. The jaw, however, is spring-biased allowing the jaw to move within the slot between an engaged and a disengaged position.

Finally, U.S. Pat. No. 4,495,865 discloses a plate-clamping device for web-fed rotary printing presses. This arrangement comprises a tightening screw and a tightening lever forced against a ratchet wheel. By means of the tightening screw the ratchet mechanisms, on both sides, are loosened, thus, allowing actuating operations.

SUMMARY OF THE INVENTION

It is an object of the present invention to allow the actuation of clamping arrangements without the use of special tools.

It is further object of the present invention to avoid damage to printing unit cylinders or injury to operators through small parts, if they came loose.

It is a further object of the present invention to have the printing unit cylinders eject the printing plate trailing edge for plate removal.

In accordance with the present invention, a printing unit cylinder comprises an actuating device for clamping arrangements for printing plates in rotary printing units. A printing unit cylinder receiving a printing plate is provided with at least one opening extending across the entire width of the printing unit cylinder. Actuating means fastened at the ends of the printing unit cylinder allow for tightening the printing plates on the outer cylindrical surface of the printing unit cylinder. The actuating means of the printing unit cylinder are operable by means of an actuating unit fastened to one or both ends of the printing unit cylinder. The actuating unit further includes an overrunning clutch which determines the rotational direction of an actuating shaft. The actuating unit is spring-biased and comprises a component which is axially movable.

In a preferred embodiment of the invention, the axially movable component is a housing having a projection which is engageable with a mounting plate. In order to receive the projection of the housing, the mounting plate is provided with a corresponding opening on its inner surface. The actuating unit comprises a handle which is connectable to the housing by means of a threaded ring. Furthermore, the handle is provided with an inner threading for receiving a set screw and with an outer threading. The threaded handle and the threaded ring are connected by means of their respective threadings. The connection of the threadings of these two components is secured by means of the set screw. The housing is located within the handle and threaded ring, thus, allowing the housing to slidingly move on the actuating shaft. On the actuating shaft there are disposed individual clamping rolls spaced apart from one another. Each of the clamping rolls has a rigid hub and a compressible covering.

If, for example, the projection of the housing is engaged with the mounting plate, the overrunning clutch blocks rotation of the actuating shaft in a releasing direction. The trailing edge of the printing plate, by action of the clamping rolls, remains tightened. However, if the housing is disengaged from the mounting plate against the force of the spring through an axial displacement of the handle, the blocking effect of the overrunning clutch is negated. Consequently, the trailing edge of the printing plate is ejected from the slot of the printing unit cylinder by means of the clamping rolls upon rotation of the actuating shaft in the releasing direction. The printing plate can then be easily removed.

BRIEF DESCRIPTION OF THE DRAWINGS

The foregoing and other features of the present invention will become apparent to those skilled in the art upon reading the following description of a preferred embodiment of the invention in view of the accompany drawings, wherein.

DESCRIPTION OF A PREFERRED EMBODIMENT

Figure 1:
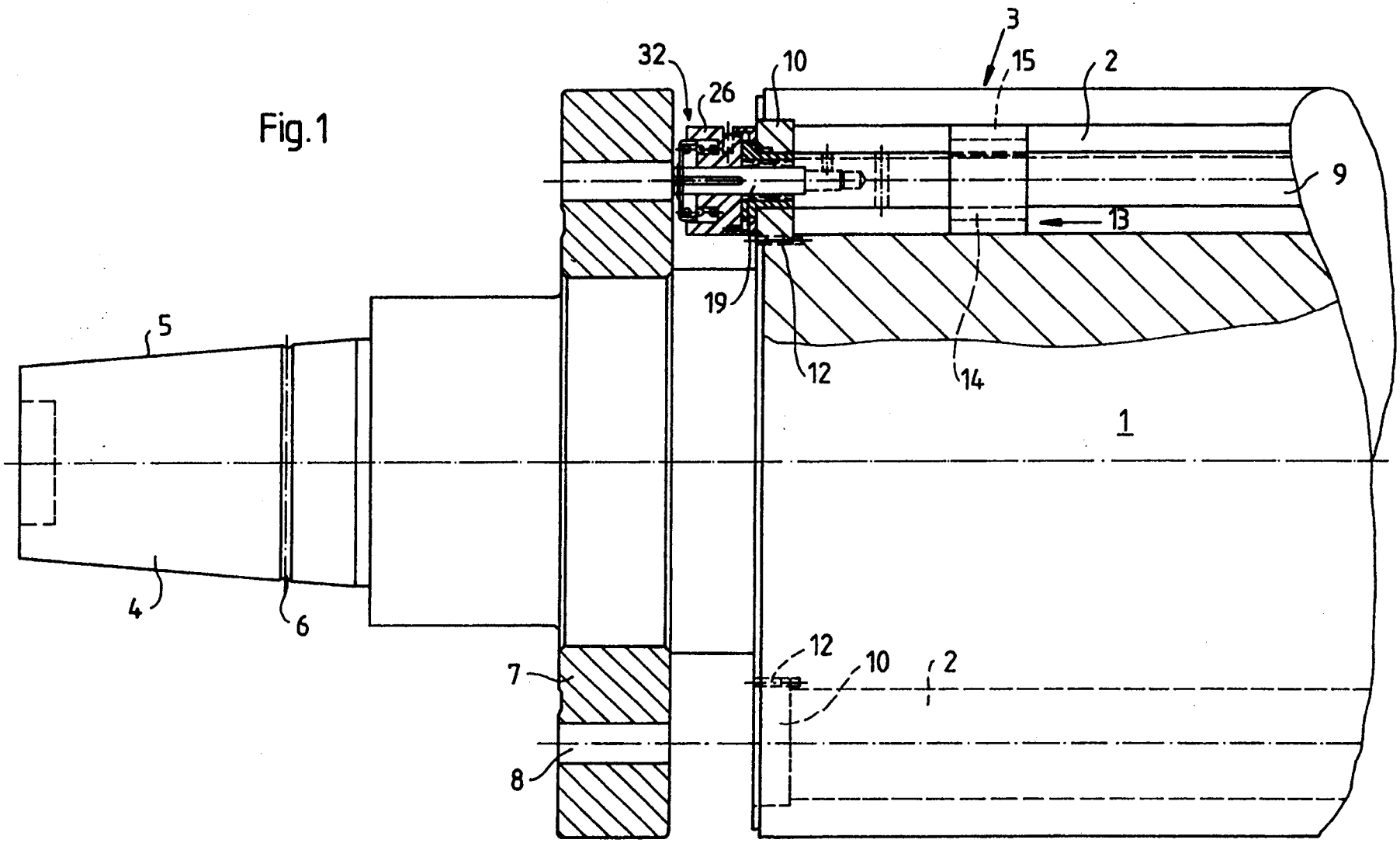
FIG. 1 is a longitudinal cross-section of a printing unit cylinder constructed in accordance with the present invention.

As shown in FIG. 1, a plate cylinder 1, on the circumference of which several printing plates can be mounted, comprises, for example, two axial bores 2 located opposite one another. The axial bores 2 can extend across the entire width of the plate cylinder 1. Respective slots 3 formed in the surface of the plate cylinder i provide access to the bores 2. Alternatively, two axial bores 2, each extending across half the width of the plate cylinder 1, as found in most double-width newspaper presses, are conceivable. A conically extending cylinder journal 4 is designed as a bearing seat 5. The cylinder bearing can be removed from the cylinder journal 4 through a bearing blow-off groove. Furthermore, a bearer 7 is mounted on the cylinder journal 4.

Actuating shafts 9 are positioned in the axial bores 2 of the plate cylinder 1. The actuating shafts 9 are received on mounting plates 10 at both ends of the plate cylinder 1. The mounting plates 10 each have locking screws 12 for securing the mounting plates 10 within the axial bores 2 and, thus, preventing them from rotating. On the actuating shafts 9 there are disposed clamping rolls 13 being individually spaced from one another. Each of the clamping rolls 13 has a roll hub 14 which is kept from rotating with respect to the actuating shaft 9 by means of a tang extending radially into corresponding key slots formed in the actuating shaft 9. A lithographic printing plate 16—shown in FIG. 5—is clamped by means of the clamping rolls 13, each of which has a roll hub 14 and an elastomeric covering 15. The ends of the printing plate 16 are clamped between the clamping rolls 13 and the surface of the plate cylinder which defines the axial bore 2, and are thus locked.

A bolt 19 for receiving an actuating unit 32 is screwed into the actuating shaft 9. A handle 26 is mounted on the bolt 19. The handle 26 is actuatable in a circumferential direction after having been released by an axial disengaging movement of a housing against the force of a spring.

Figure 2A:
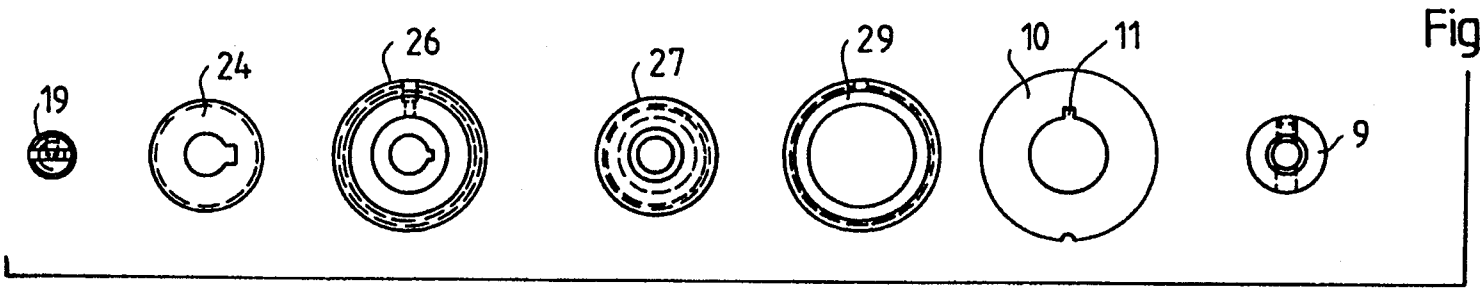
FIGS. 2*a* and 2*b* are a views of the individual components of an actuating unit constructed in accordance with the present invention.
Figure 2B:
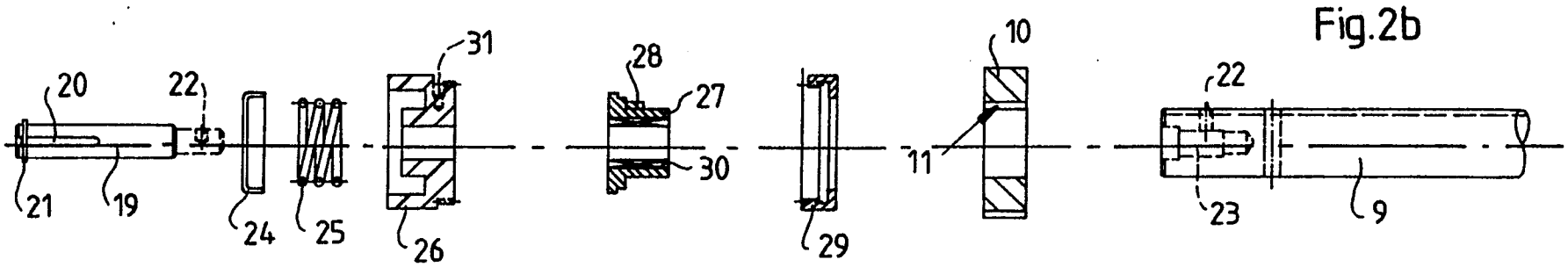

FIGS. 2*a* and 2*b* show the individual components of the actuating unit 32.

The bolt 19 is provided with a key slot 20. The threadings of the bolt 19 and of the actuating shaft 9 hold a set screw 22 for securing a certain rotational position of both components so that the bolt 19 and actuating shaft 9 do not rotate relative to each other. A retaining ring 21 is mounted on the bolt 19. A dome-shaped cup 24 is pushed against the retaining ring 21 by a helical spring 25. The helical spring 25 is located within the handle 26. By means of a key (not shown) on the handle 26, which engages in the key slot 20 of the bolt 19, rotation of the actuating shaft 9 relative to the handle 26 is prevented, whereas axial displacement of the handle 26 relative to the actuating shaft 9 is possible. Furthermore, the handle 26 comprises an inside threading 31 and an outside threading. A threaded ring 29 is screwed onto the threaded handle 26. The connection between the handle 26 and the threaded ring 29 is secured by means of a set screw engaging in the outside threading 31 of the handle 26.

A housing 27 is received between the handle 26 and the threaded ring 29. The housing receives in its bore an overrunning clutch 30. The overrunning clutch 30 permits rotation of the bolt 19 and the actuating shaft 9 relative to the housing 27 in one direction, and blocks rotation of the bolt 19 and the actuating shaft 9 relative to the housing 27 in the opposite direction. The overrunning clutch 30 is shown schematically in the drawings. The structure and function of such a device is known in the art.

On its outer circumference the housing 27 has a projection 28. As the threaded ring 29, which abuts to a ring-shaped shoulder of the housing 27, is connected to the handle 26, the housing 27 is compelled to move with the handle 26 when it is axially pulled along the bolt 19. Axial movement of the handle can be performed either by the operator or by the helical spring 25.

The sleeve-shaped part of the housing 27 with the projection 28 on its circumference protrudes into the bore of the mounting plate 10. The mounting plate 10 is secured against rotational movement by means of the locking screw 12. In the engaged state, the projection 28 of the housing 27 is located within and engages an inner slot 11 of the mounting plate 10, due to the force of the helical spring 25. In the disengaged state, the housing 27 is pulled by the operator against the force of the helical spring 25, so that the projection 28 is removed from and no longer engages the slot 11 of the mounting plate 10.

Figure 3:
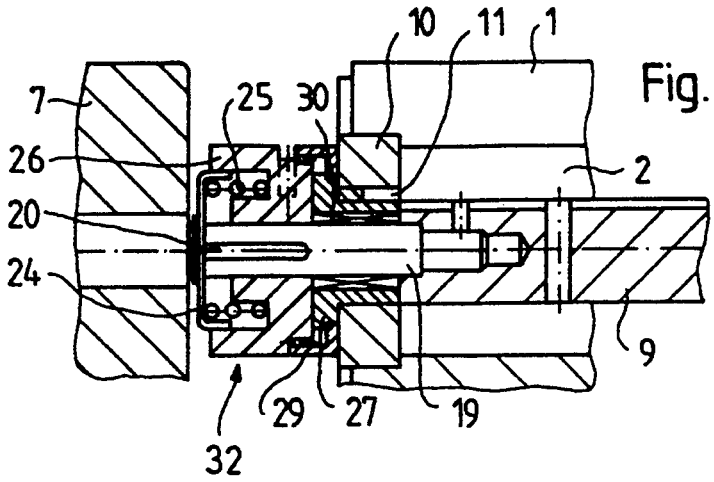
FIG. 3 is a cross-section of the actuating unit during operation.

FIG. 3 is a cross-section of the actuating unit 32 during operation.

During operation of a rotary printing press, i.e. when the printing plates 16 are securely clamped on the plate cylinder 1, the handle 26 and the threaded ring 29 are urged against the mounting plate 10 by the helical spring 25. The helical spring 25 is counterpoised by means of the cup 24 which is axially secured by the retaining ring 21. The projection 28 of the housing 27 engages in the inner slot 11 of the mounting plate 10. Because of the key on the handle 26, which engages in the key slot 20, the actuating unit 32 (comprising the components 24, 25, 26, 29 and 31) is rotationally locked with respect to the bolt 19. By turning the handle 26 in a tightening direction, the bolt 19 and the actuating shaft 9 are turned in the tightening direction as well, causing the clamping rolls 13 to tighten a printing plate trailing edge 18 (see FIG. 5) within the cylinder slot 3. The clamping force exerted upon the plate edge 18 is created between the covering 15 of the clamping rolls 13 and the surface of the axial bore 2. A rotational movement of the actuating shaft 9 in a releasing direction opposite to the tightening direction is prevented by the overrunning clutch 30, which is locked with respect to the plate cylinder 1 in that the projection 28 engages in the mounting plate 10.

Figure 4:
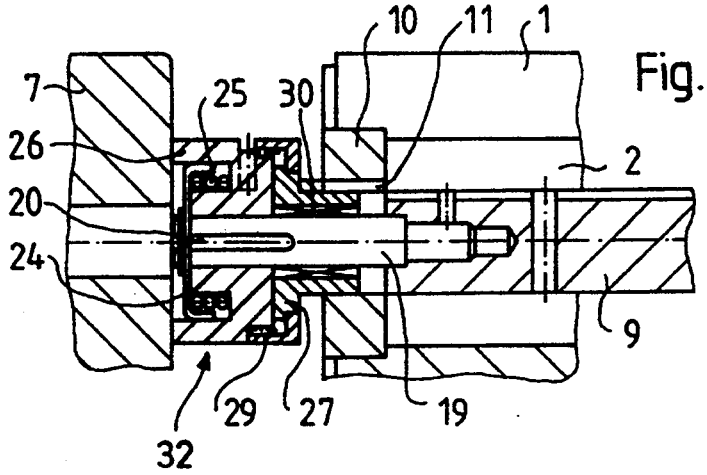
FIG. 4 is a cross-section of the actuating unit during the change of printing plates.

FIG. 4 is a cross-section of the actuating unit 32 during the change of the printing plates.

In this operating position, the handle 26 is pulled by the operator against the force exerted by the helical spring 25. Therefore, the projection 28 on the housing 27 is pulled out of the slot 11 of the mounting plate 10. In this position, the locking function of the overrunning clutch 30 is negated, which causes the release of tension of the lithographic plate 16 when the handle 26 is turned in the releasing direction. The turning of the handle 26 in the releasing direction causes the trailing edge 18 to be ejected from the cylinder slot 3. Upon release of the leading edge 17 the plate can be easily removed from the printing unit cylinder 1.

Figure 5:
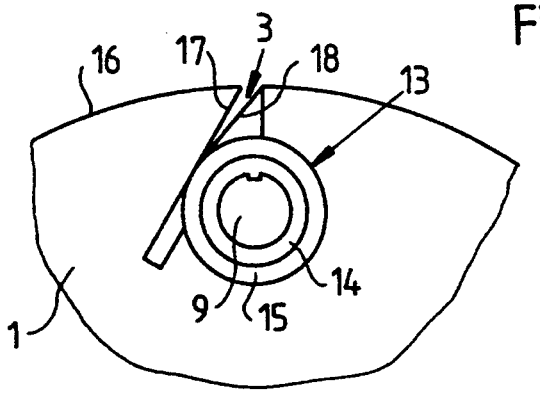
FIG. 5 is a schematic side view of the printing unit cylinder showing an axial bore and a slot.

FIG. 5 is a schematic side view of the plate cylinder 1 showing one of the bores 2 and the respective slot 3.

The leading edge 17 of the plate 16 is hung into the slot 3 of the plate cylinder 1 so as to be in correct register. The clamping rolls 13 clamp the trailing edge 18 of the plate 16 against the cylinder wall defining the axial bore 2. The coverings 15 of the clamping rolls 13 are slightly compressed, thus, securing a tensioning force exerted upon the trailing edge 18. The roll hubs 14, which are secured on the actuating shaft 9 by tangs against rotational movement, engage in key slots in order to maintain the clamping position of the trailing edge 18 of the plate 16. When the actuating shaft 9 is turned counterclockwise, as viewed in FIG. 5, the trailing edge 18 of the plate 16 is pulled into the slot 3. This allows a further tensioning of the lithographic printing plate 16 after an operating period.

When the actuating shaft 9 is turned clockwise following disengagement of the projection 28, the effect of the overrunning clutch 30 is negated and the plate trailing edge 18 is ejected from the cylinder slot 3 of the printing unit cylinder 1.

From the above description of the invention, those skilled in the art will perceive improvements, changes and modifications. Such improvements, changes and modifications within the skill of the art are intended to be covered by the appended claims.

Having described the invention, the following is claimed:

1. An actuating device for clamping arrangements for lithographic plates in rotary printing presses including a printing unit cylinder provided with at least one opening extending in an axial direction, in which actuating means fastened at the ends of the printing unit cylinder allow for tightening the lithographic plates on the surface of the printing unit cylinder and the actuating means are operable by an actuating unit fastened to one or both ends of the printing unit cylinder, characterized in that:

the actuating unit (32) includes an overrunning clutch (30) which determines the rotational position of an actuating shaft (9), said actuating unit being spring-biased and comprising an axially movable component (27).

2. An actuating device for clamping arrangements for lithographic plates according to claim 1, characterized in that the axially movable component (27) has a projection (28) which is engageable in a mounting plate (10).

3. An actuating device for clamping arrangements for lithographic plates according to claim 2, characterized in that the mounting plate (10) is provided with an axially extending slot (11).

4. An actuating device for clamping arrangements for lithographic plates according to claim 1, characterized in that the actuating unit (32) comprises a handle (26) through which a threaded ring (29) cooperates with the axially movable component (27).

5. An actuating device for clamping arrangements for lithographic plates according to claim 4, characterized in that the handle (26) is provided with an inner threading and an outer threading.

6. An actuating device for clamping arrangements for lithographic plates according to claim 4, characterized in that the handle (26) and the threaded ring (29) are connected with each other by means of a screw in such a way, that through axial movement of said handle (26) the component (27) is slidable on a bolt (19).

7. An actuating device for clamping arrangements for lithographic plates according to claim 1, characterized in that on the actuating shaft (9) there are disposed a number of clamping rolls (13) being individually spaced from one another and being secured against rotation relative to said actuating shaft (9).

8. An actuating device for clamping arrangements for lithographic plates according to claim 1, characterized in that each of the clamping rolls (13) comprises a respective roll hub (14) which is guidable in a key slot of the actuating shaft (9).

9. An actuating device for clamping arrangements for lithographic plates according to claim 7, characterized in that each of the clamping rolls (13), on its outside circumference, is provided with a respective compressible covering (15).

10. An actuating device for clamping arrangements for lithographic plates according to claim 2, characterized in that on the actuating shaft (9) there are disposed a number of clamping rolls (13) being individually spaced from one another and being secured against rotation relative to said actuating shaft (9), and being further characterized in that said clamping rolls (13) comprise means for tightening the trailing edge (18) of the plate (16) upon turning of the spring-biased actuating unit (32) at the handle (26) when the projection (28) of the housing (27) is engaged in the mounting plate (10), the trailing edge (18) of the plate (16) thus being tightened in an axial bore (2) of the printing unit cylinder (1) by means of clamping rolls (13) in a direction allowed by the overrunning clutch (30).

11. An actuating device for clamping arrangements for lithographic plates according to claim 2, characterized in that on the actuating shaft (9) there are disposed a number of clamping rolls (13) being individually spaced from one another and being secured against rotation relative to said actuating shaft (9), and being further characterized in that said clamping rolls (13) comprise means for ejecting the trailing edge (18) of the plate (16) upon turning of the spring-biased actuating unit (32) at the handle (26) when the projection (28) of the housing (27) is disengaged from the mounting plate (10), the locking effect of the overrunning clutch (30) working against the releasing direction of the lithographic plate (16) thus being negated, and the trailing edge (18) of said lithographic plate (16) thus being ejected from the axial bore (2) of the printing unit cylinder (1) by means of the clamping rolls (13).

12. Apparatus for releasably clamping a printing plate (16) onto a plate cylinder (1), said apparatus comprising:

a rotatable actuating shaft (9) extending axially along the cylinder (1), said actuating shaft (9) having clamping means (13) for engaging the printing plate (16), said clamping means (13) tightening the printing plate (16) on the cylinder (1) upon rotation of said actuating shaft (9) in a tightening direction and releasing the printing plate (16) for removal from the cylinder (1) upon rotation of the actuating shaft (9) in a releasing direction; and actuator means (32) for controlling rotation of said actuating shaft (9), said actuator means (32) including a clutch (30) which is movable axially relative to said actuating shaft (9) between a first position and a second position, said clutch (30) acting between the cylinder (1) and said actuating shaft (9) to block rotation of said actuating shaft (9) in said releasing direction when said clutch (30) is in said first position, said clutch (30) releasing said actuating shaft (9) for rotation in said releasing direction upon movement of said clutch (30) from said first position to said second position;

said actuator means further including spring means (25) for urging said clutch (30) from said second position toward said first position.

13. Apparatus as defined in claim 12 wherein said clutch (30) is movable manually from said first position to said second position against the bias of said spring means (25).

14. Apparatus as defined in claim 13 wherein said actuator means (32) further includes a handle (26) for manually rotating said actuating shaft (9) in said tightening direction and in said releasing direction.

* * * * *